United States Patent [19]

Drew

[11] Patent Number: 4,746,424

[45] Date of Patent: May 24, 1988

[54] FLOATING SWIMMING POOL SKIMMER

[76] Inventor: Richard H. Drew, 756 Camino Ricardo, Moraga, Calif. 94556

[21] Appl. No.: 926,508

[22] Filed: Nov. 3, 1986

[51] Int. Cl.[4] ..... E04H 3/20

[52] U.S. Cl. ..... 210/169; 210/242.1; 4/490; 134/167 R; 137/624.14

[58] Field of Search ..... 210/169, 416.2, 232, 210/242.1; 4/490; 134/167 R; 137/624.14

[56] References Cited

U.S. PATENT DOCUMENTS

| | | | |
|---|---|---|---|
| 1,579,917 | 4/1926 | Deming | 210/242.1 |
| 2,725,356 | 11/1955 | Lombardi | 210/805 |
| 2,989,185 | 6/1961 | Lombardi | 210/776 |
| 3,170,180 | 2/1965 | Winston et al. | 134/167 R |
| 3,263,811 | 8/1966 | Baker et al. | 210/136 |
| 3,268,079 | 8/1966 | Sharrow, Jr. | 210/169 |
| 3,291,145 | 12/1966 | Arneson | 134/167 R |
| 3,782,552 | 1/1974 | Wendell | 210/242.1 |
| 3,794,052 | 2/1974 | Koble, Jr. et al. | 210/169 |
| 3,796,373 | 3/1974 | Moore | 134/167 R |
| 3,805,815 | 4/1974 | Goodin | 134/167 R |
| 3,883,366 | 5/1975 | Blumenfeld | 134/167 R |
| 4,077,424 | 3/1978 | Ehret et al. | 137/624.14 |
| 4,105,557 | 8/1978 | Weatherbolt | 134/167 R |
| 4,289,155 | 9/1981 | Sable | 134/167 R |
| 4,348,192 | 9/1982 | Pansini | 134/167 R |
| 4,405,458 | 9/1983 | McHugh, Jr. | 210/242.1 |
| 4,429,429 | 2/1984 | Altschul | 134/167 R |
| 4,458,708 | 7/1984 | Leonard et al. | 137/624.14 |
| 4,569,361 | 2/1986 | Frentzel | 134/167 R |
| 4,624,274 | 11/1986 | Norton | 134/167 R |
| 4,647,374 | 3/1987 | Ziaylek et al. | 210/242.1 |

FOREIGN PATENT DOCUMENTS

| | | | |
|---|---|---|---|
| 590252 | 8/1952 | Canada | 210/242.1 |
| 0651371 | 10/1928 | France | 210/242.1 |

*Primary Examiner*—Richard V. Fisher
*Assistant Examiner*—Coreen Y. Lee
*Attorney, Agent, or Firm*—Townsend & Townsend

[57] ABSTRACT

A propelled floating swimming pool skimmer having a plurality of angularly related channels with gate means in each of the channels permitting ingress of water and floating leaves and debris into a central area of the body of the device. Nozzles around the periphery of the body propel the unit in desired directions which change automatically in a desired sequence so the unit will cover the entire pool surface. The entrapped leaves and debris are forced downwardly in a spiral path by downwardly-directed jets into a mesh bag in which the leaves and debris may be removed from the pool and, in another form, the leaves and the debris are drawn downwardly through a mesh basket and then through a flexible conduit to the swimming pool vacuum system. Propulsion is accomplished by water under pressure furnished through a flexible conduit to the unit from a suitable source.

38 Claims, 4 Drawing Sheets

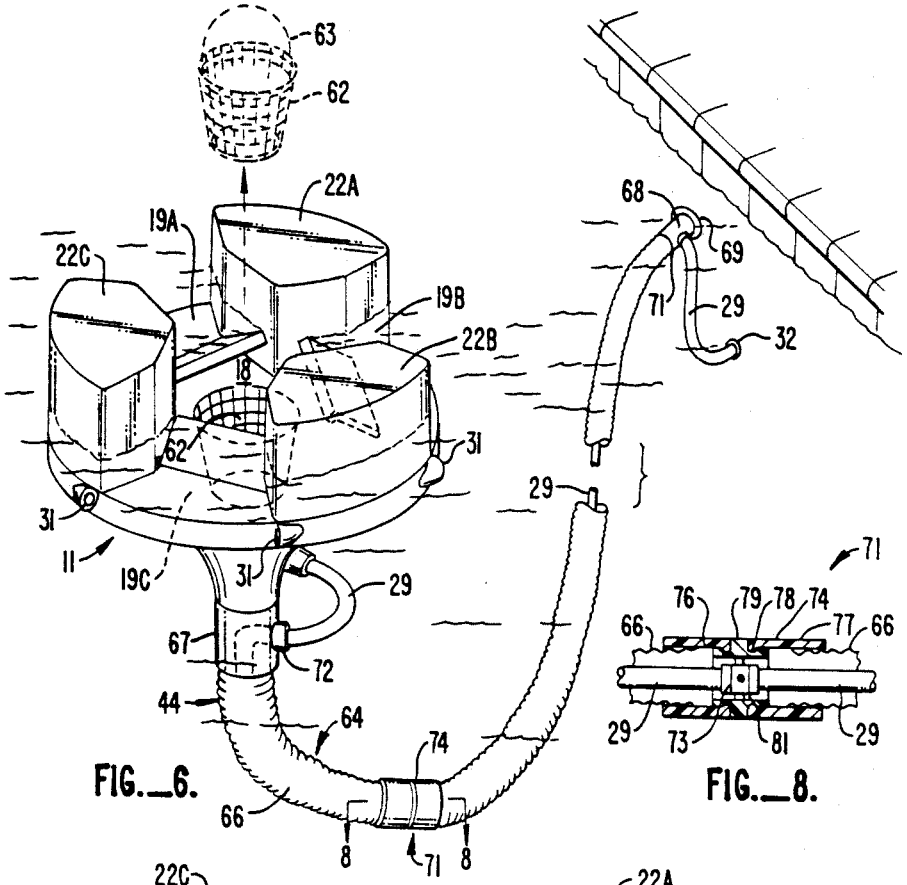
FIG._6.
FIG._8.
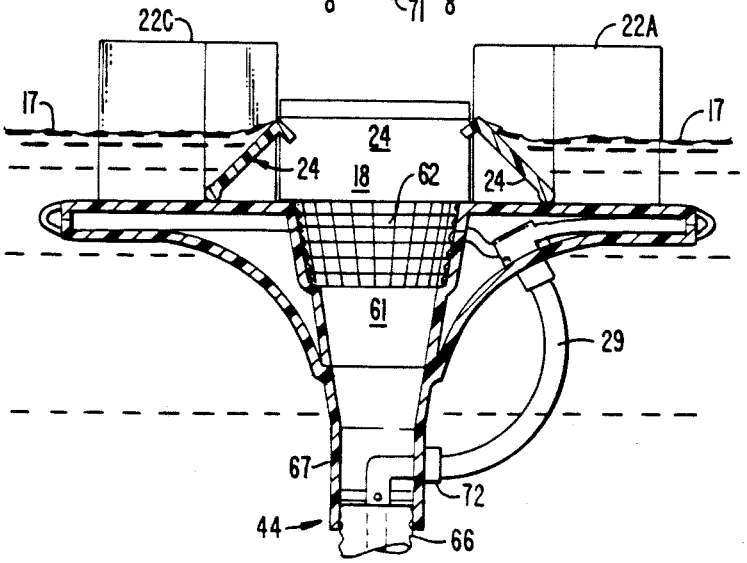
FIG._7.

FLOATING SWIMMING POOL SKIMMER

BACKGROUND OF THE INVENTION

1. Field of the Invention.

This invention relates to apparatus for removing floating debris from the surface of a pool of liquid, and more particularly to devices movable over the surface of the water of a swimming pool for removing floating leaves, bugs and other debris.

2. Description of the Prior Art.

(The term "prior art" as used herein, or in any statement by or on behalf of applicant, means only that any document or thing referred to as prior art bears, directly or inferentially a date which is earlier than the effective filing date hereof).

Leaves and other floating debris are commonly removed from swimming pools by "skimmers" built into the walls of the pool at the normal water level. Wave action in the pool, generated by people using the pool and/or by the wind, is supposed to wash the floating leaves, etc. into troughs or openings in the wall of the pool, from whence they are drawn by a line connected to the suction side of the swimming pool pump. This system is less than satisfactory, particularly where the wind tends to blow floating leaves and debris against the pool walls remote from the skimmer. Also, fluctuations in the water level adve effect the operation of such fixed skimmers, even to the point of becoming inoperative when the water level rises or falls even two or three inches.

Attempts have been made to cope with fluctuations in the water level of the pool by devices such as that shown in U.S. Pat. No. 3,268,079 to Gilfred J. Sharrow, Jr. wherein the skimmer unit floats in the water and hence always remains at the same position relative to the pool surface, even though the skimmer intake unit moves up and down with changes in the water level. These devices do not move about the pool, but rather are tethered in one place as shown in the Sharrow, Jr patent.

It has been proposed to float the skimmer unit in the pool water, and move the skimmer unit over the surface of the pool in such manner that it eventually covers the entire surface and thus is much more likely to pick up floating leaves and debris. An example of this approach is found in U.S. Pat. No. 4,105,557 to Brian R. Weatherholt wherein a flat, platter-shaped floating housing has a mesh bottom and is dragged around the pool behind a conventional pool cleaner having a plurality of flexible whips or tentacles. The range and character of movement of the Weatherholt skimmer, as well as its capacity for holding debris, is extremely limited.

U.S. Pat. No. 2,989,185 to Oliver M. Lombardi illustrates a skimmer which floats on the surface of the water and which has a depending open mesh bag into which the floating leaves and debris are propelled downwardly by a jet of water. The Lombardi device moves over the surface of the swimming pool solely under the influence of air currents.

In addition to the patents discussed above, it is believed that the patents listed below contain information which is or might be considered to be material to the examination of this application.

| U.S. Pat. No. | Inventor |
|---|---|
| 2,725,356 | O. Lombardi |
| 3,263,811 | W. Baker et al. |
| 3,291,145 | H. Arneson |
| 3,805,815 | R. Goodin |
| 3,883,366 | C. Blumenfield |
| 4,289,155 | C. Sable |
| 4,348,192 | A. Pansini |
| 4,569,361 | H. Frentzel |

These patents are believed to be relevant to the present invention because they were adduced by a prior art search made by an independent searcher.

A copy of each of the above-listed and above-discussed patents is supplied to the Patent and Trademark Office herewith No representation or admission is made that any of the enclosed documents is part of the prior art, in any acceptation of that term, or that no more pertinent information exists

SUMMARY OF THE INVENTION

The floating swimming pool skimmer of the present invention is self-propelled and is able to move laterally on the surface of the pool in a manner eventually covering the entire pool surface for obtaining relatively complete skimming action. The present skimmer utilizes water under pressure, either from the discharge side of the swimming pool pump, or from the city water system, or from a special high-pressure pump such as those commonly used with whip-type swimming pool cleaning devices.

The water under pressure is projected horizontally from a plurality of nozzles spaced around the periphery of the skimmer. A valving control system is provided which directs the water under pressure sequentially through the different nozzles so that the reaction from the jets of water emanating from the nozzles will move the entire floating skimmer across the surface of the pool first in one direction, then in another direction, then in a third direction, with each of these directions being circumferentially angularly related to each other. This causes the skimmer unit to move erratically and randomly about the pool and assures coverage of the entire pool surface.

The present skimmer collects leaves and floating debris mostly from the direction in which the skimmer is moving, and the skimmer is formed to entrap collected leaves and debris near its center. From the center of the skimmer, the collected leaves and debris are displaced downwardly by being entrained upon a downwardly-directed current of water. This current either passes into a mesh bag from whence the water can reenter the pool while the leaves and debris are retained by the bag, or the current first passes through a removable wire mesh basket and then is drawn off to the swimming pool pump filter through a flexible conduit attached to the usual vacuum cleaner fitting found in the wall of the pool.

It is therefore a principal object of the present invention to provide a self-propelled floating swimming pool skimmer which is capable of moving over the entire surface of the pool and collecting leaves and floating debris therefrom.

Another object of the present invention is to provide a floating swimming pool skimmer capable of automatically moving sequentially in different directions, and having a plurality of radially extending open channels for admitting debris-laden water to the central area of the skimmer.

A further object of the present invention is to provide a floating swimming pool skimmer of the character described which urges water and floating leaves and debris downwardly in a novel spiraling pattern to an open mesh bag retaining the leaves and debris while releasing the water entering it.

A still further object of the present invention is to provide a floating swimming pool skimmer of the character descibed in which the larger water-bearing leaves and floating debris are removed from the central area of the skimmer by a mesh basket, and the smaller leaves and debris proceed through a flexible conduit capable of being connected to a conventional pool vacuum cleaner fitting.

Yet another object of the present invention is the provision, in a self-propelled floating swimming pool skimmer of the character set forth, of a water-driven valve formed for automatically and sequentially providing water to nozzles at periphery of the skimmer so as to cause the skimmer to move sequentially in different directions about the pool.

Other objects and features of advantage will become apparent as the specification progresses and from the claims.

BRIEF DESCRIPTION OF THE DRAWINGS

FIG. 6 is a perspective view of a modified form of the invention illustrating how the apparatus may be connected to a conventional swimming pool vacuum cleaner inlet for removing the collected leaves and debris.

FIG. 7 is a vertical cross-sectional view through the apparatus of FIG. 6.

FIG. 8 is an enlarged vertical cross-sectional view taken substantially on the plane of Line 8—8 of FIG. 6

Figure 1:
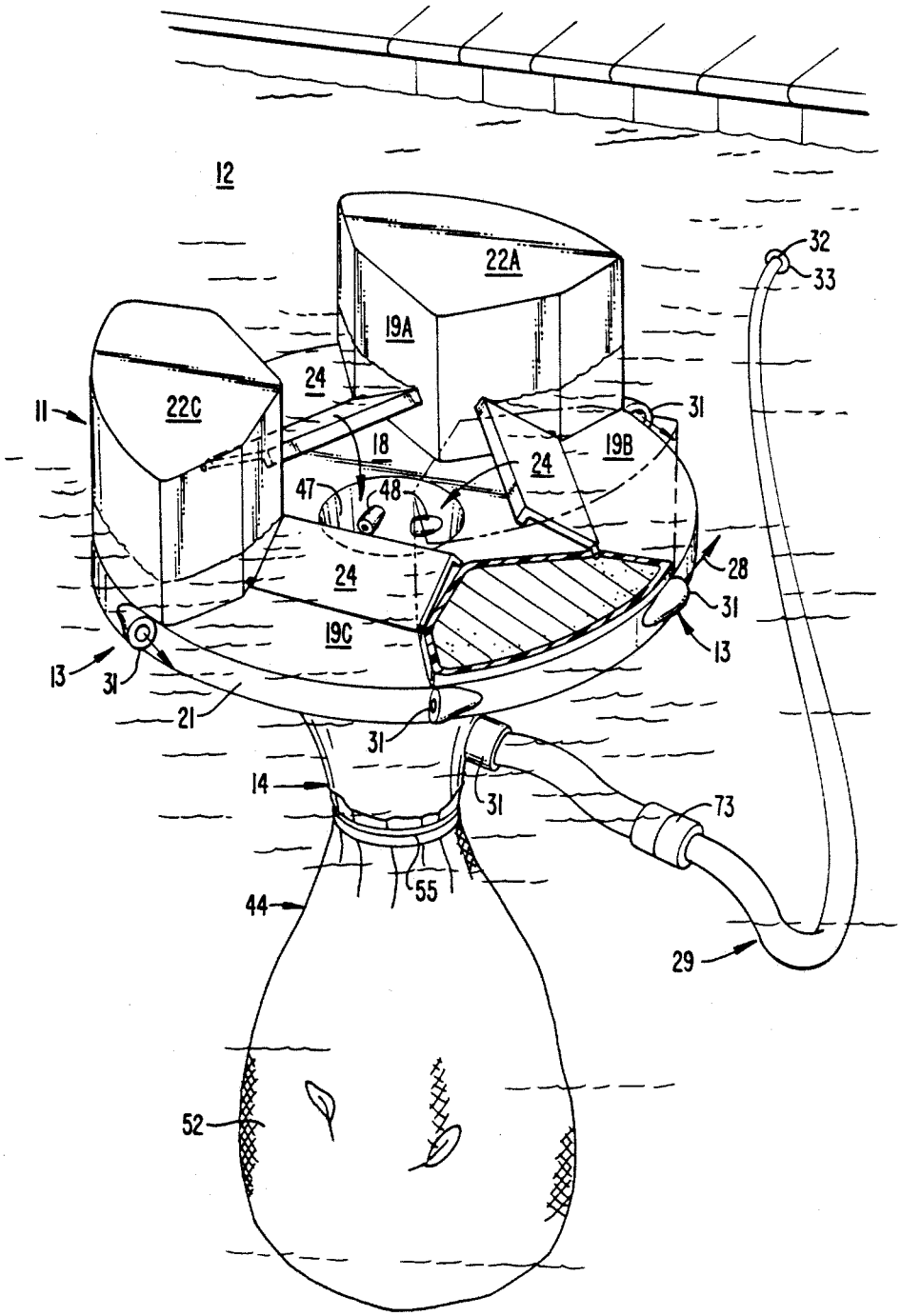
FIG. 1 is a perspective view of a self-propelled floating swimming pool skimmer made in accordance with the present invention and shown in operative position in the water of a swimming pool.

While only the preferred forms of the invention are illustrated in the drawings, it will be apparent that various modifications could be made without departing from the ambit of the claims.

DESCRIPTION OF THE PREFERRED EMBODIMENTS

As may be seen in the accompanying drawings, the self-propelled floating swimming pool skimmer of the present invention provides a body 11 floatable on a liquid (in this case, the water of a swimming pool 12) propulsion means 13 on the body 11 formed for driving the body 11 randomly over the pool surface, and collecting means 14 on the body 11 formed for entraping debris 16 encountered by the body 11 on the surface 17 of the pool 12.

In accordance with the present invention, the body 11 is formed with channels 19 opening from the central area 18 to the periphery 21 of the body 11 at and below the surface 17 of the pool 12 whereby debris 16 on such surface can pass into the central area 18 through one or more of the channels 19 opening in the direction of movement of the body 11.

As here shown, three channels 19A, 19B and 19C are formed in the body 11 between upwardly projecting flotation blocks 22A 22B and 22C. Preferably, there are at least three of the channels 19 so that floating debris 16 will be entering at least one of the channels during motion of the body 11 in any direction. It should be evident, however, that more than three channels can be utilized so long as they are relatively evenly spaced around the periphery of body 11.

Gate means 23 is mounted across each of the channels 19, with each such gate means being formed for admitting surface debris 16 and the liquid upon which such debris floats through such channel and into the central area 18, the gate means 23 further being formed for retaining such debris in the central area 18 against egress through their associated channels.

As shown in the drawings, gate means 23A, 23B and 23C are mounted across channels 19A, and 19C, respectively. Particularly as shown in FIG. 3 of the drawings, each of the gate means 23 provides a flap 24 proportioned to extend across an associated channel 19, with each of the flaps 24 being mounted on the body across its associated channel 19 in inwardly upwardly inclined position, with the upper edge 26 of the flap just above the pool surface 17 whereby the debris 16 floating on the surface of the pool are washed inwardly across the flap 24 into the central area 18, but are restrained by the upper edge 26 of the flap from washing back out of the central area 18.

Figure 3:
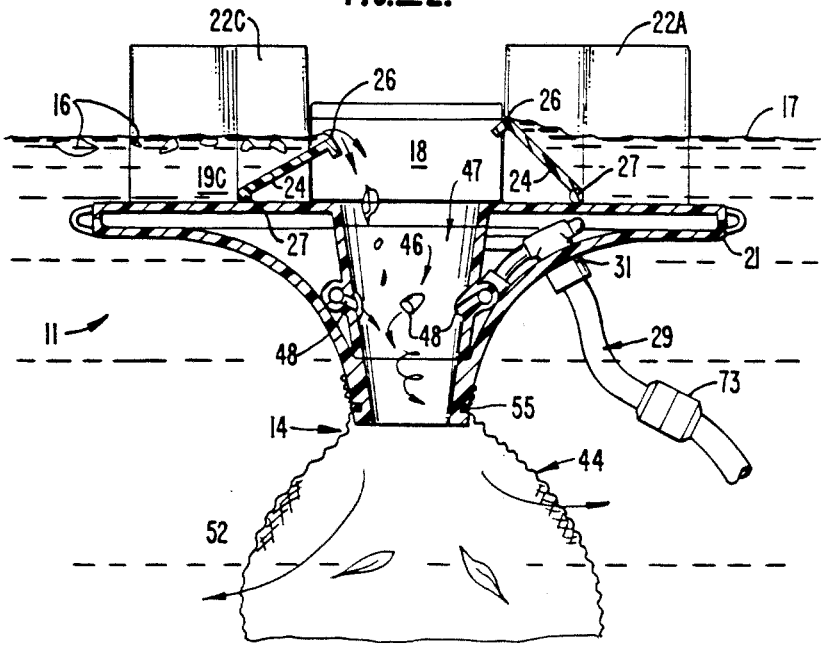
FIG. 3 is a vertical sectional view taken substantially on the plane of Line 3—3 of FIG. 2.

Each of the flaps 24 is floatable in the liquid of the pool 12, and hinge means 27 is provided for pivotally mounting the lower edges of the flaps 24 to the body 11 so that the upper edges 26 of the flaps can float up slightly above the pool surface 17, see the right-hand poriton of FIG. 3. Because of the pivotal mounting of the flaps 24, water and floating debris 16 entering the channel forces the upper edges 26 of flap 24 downwardly somewhat so that the leaves and debris 16, and some of the water upon which they float, pour over the upper edge 26 into the central area 18 of the body 11, see the left-hand side of FIG. 3.

As an important feature of the present invention, the propulsion means 13 provides a plurality of horizontal angularly related liquid jets 28 on body 11 formed for driving the body over the pool surface as a reaction to the particular jet or jets which are turned on.

Figure 2:
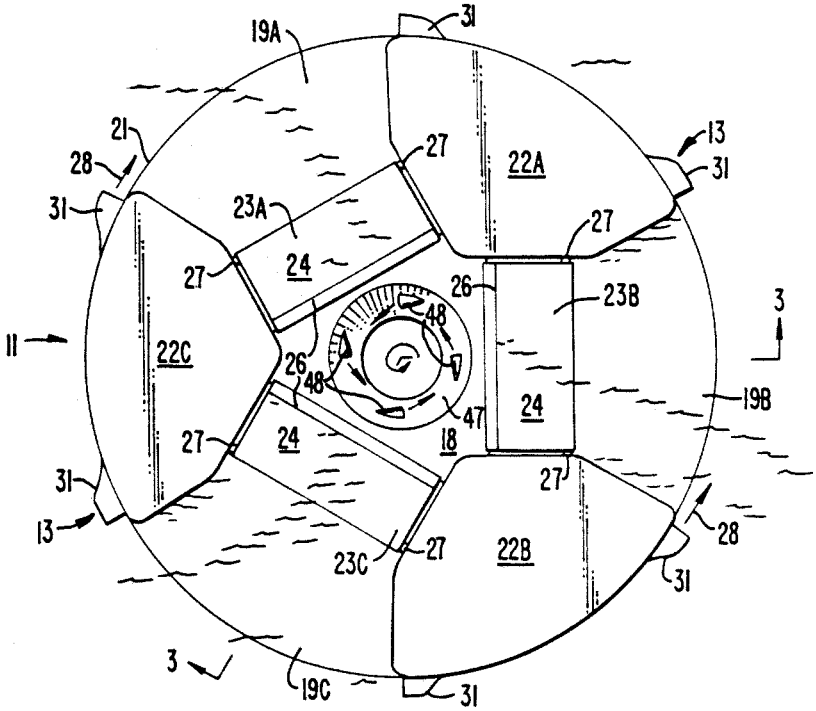
FIG. 2 is a plan view of the apparatus of FIG. 1.

As illustrated in FIGS. 1 and 2 of the drawings, the jets 28 cause the entire body 11 to move in a direction opposite to the direction of the jets, causing water and floating leaves and debris 16 to enter the channel 19C and fall over the gate means 23C into the central area 18 of the body, from whence the leaves and debris 16 proceed to the collecting means 14. Turning off of the jets 28 and turning on of others of the angularly related jets causes the body 11 to move over the pool surface 17 in a different direction.

The apparatus of the present invention also includes flexible conduit means 29, such as a hose, carried at one end 31 by the body 11 and having an opposite end 32 adapted for connection to a source of liquid under pressure (not shown). This source can be either the pressure side of the swimming pool pump which feeds water back into the swimming pool through fitting 33, or a connection to the city water supply, or a connection to the high pressure pump normally provided with a whip-type pool cleaner, or a special pump reserved for the purpose of actuating the pool skimmer.

A plurality of nozzles 31, formed for projecting the liquid jets 28 are mounted at the peripheral rim 21 of the body 11 in circumferentially spaced relation. The nozzles are oriented so that jets of water emanating therefrom are tangent to the circumference of the body 11, and the nozzles 31 are arranged in pairs on opposite sides of the body 11 so that when a pair of the jets are turned on, their forces will balance from side to side of the body 11 and drive it in a substantially straight line. Of course, the drag of the hose 29, the effect of wind and waves on the floatation blocks 22, and imbalances between nozzles can all affect the course of travel of the unit. However, the skimmer travels basically in one direction until it collides with the edge of the pool or until one pair of jets is turned turned off and another pair is turned on.

Figure 4:
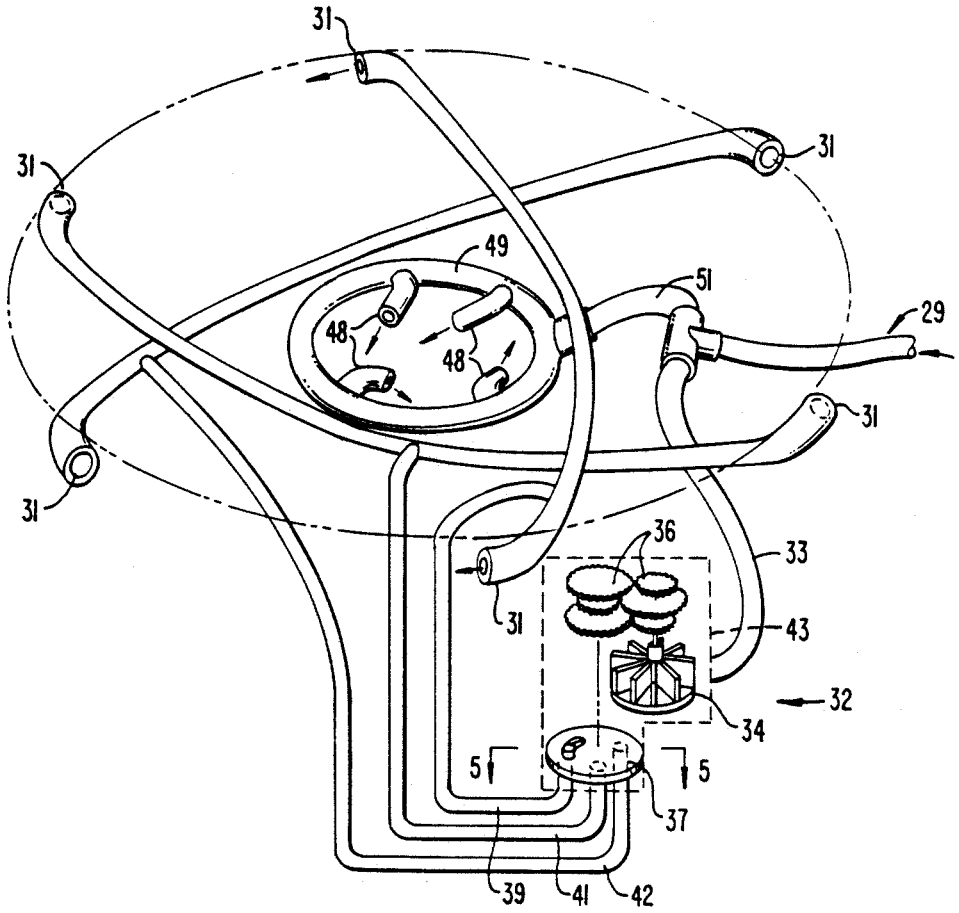
FIG. 4 is a schematic view of a plurality of horizontally directed and circumferentially spaced skimmer driving nozzles and a plurality of downwardly inclined debris removal nozzles formed for driving the captured leaves and debris into collecting devices, together with their associated conduits and a rotary plate valve driven through a gear reducer by a waterwheel which is, in turn, driven by water under pressure

Control means 32 is provided for selectively connecting the pairs of nozzles to the conduit means 29. As may best be seen in FIG. 4 of the drawings, a conduit 33 branches off from conduit 29 and connects to the control means 32. Within control means 32 is a waterwheel 34 connected through a set of reducing gears 36 to a rotary plate valve 37 having an opening 38 there through successively registerable with conduits 39, 41 and 42.

Figure 5:
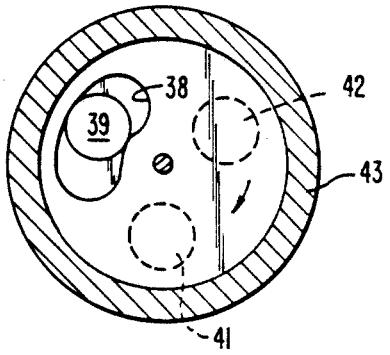
FIG. 5 is an enlarged vertical cross-sectional view of the rotary plate valve taken substantially on the plane of Line 5—5 of FIG. 4.

The waterwheel 34 spins rapidly as water passes through the housing 43 of control means 32. The gear reduction unit 36 greatly slows down the rotational speed received from waterwheel 34 so that plate valve 37 moves very slowly (typically at about the speed of the second hand of a clock). The opening 38 is elongated so that water is supplied therethrough to one of the conduits 39, 41 and 42 for a considerable period of time. As opening 38 moves from the position shown in FIG. 5 of the drawings communicating conduit 39 with the water under pressure, it eventually closes off conduit 39 and opens conduit 42, etc. This causes the jets from the nozzles 31 to be operated automatically and sequentially so that the skimmer unit will be driven ramdomly first one way, then another way, then another way.

Thus, the control means provides valve means formed for automatically and selectively connecting the nozzles 31 in desired sequence to the conduit means 29 for driving the body 11 randomly over the surface 17 of the liquid in the pool 12.

The waterwheel 34 and reduction gears 36 provide actuating means for operating the valve means in response to the flow of liquid through the conduit means.

The rotary, multi-port valve means 37 is in the form of a disk-shaped plate having an opening 38 therethrough selectively registerable with sub-conduits 39, 41 and 42 leading to the opposed pairs of nozzles 31 as the disk-shaped plate rotates.

In accordance with the present invention, the collecting means 14 is carried by the body 11 and is formed for confining the debris 16 in the central area 18 for removal from the pool The collecting means 14 automatically returns the liquid captured with the debris 16 to the liquid of the pool 12. As here shown, the collecting means 14 is formed to draw the debris 16 and liquid upon which the debris floats through the channels 19 into the central area 18 and thence downwardly, and disposal means 44 is connected to the collecting means 14 for receiving the debris 16 therefrom.

Preferably, the collecting means is formed to induce a downward flow of liquid and leaves and debris 16 from the channels 19 through the central area 18 of body 11. The disposal means 44 is formed for separating the liquid from the leaves and debris 16 and returning the liquid to the pool.

In the form of the invention illustrated in FIGS. 1 through 4 of the drawings, a downwardly directed liquid jet means 46 at the central area 18 is formed for entraining the liquid and leaves and debris 16 captured in central area 18 for inducing the described downward flow of liquid and debris to the disposal means 44

As may best be seen in FIG. 3 of the drawings, the body 11 at the central area 18 is formed with a downwardly constricting throat 47 for channeling the liquid and debris 16 entering the central area 18 downwardly to the disposal means 44. The downwardly directed liquid jet means 46 is supplied by a plurality of downwardly directed nozzles 48 mounted in circumferentially spaced relation around the inner periphery of the throat 47. A manifold 49 supplies liquid under pressure to the nozzles 48 by means of a connection 51 to the conduit 29.

The nozzles 48 are formed and angled so that the downwardly-directed jets of liquid emanating therefrom describe a spiral path down the throat 47 (see FIG. 3) whereby the liquid and debris 16 entrained by the downwardly-directed jets of liquid follow a similar spiral path.

In the form of the invention illustrated in FIGS. 1 through 4, the disposal means 44 consists of an open mesh bag 52 removably secured, as by tying with a cord 55, to the lower end of the downwardly-extending throat 47. Leaves and other debris carried downwardly into the bag 52 by the current spiralling downwardly in throat 47.

In the form of the invention illustrated in FIGS. 6 and 7 of the drawings, the structure is similar to that shown in FIGS. 1 through 4 of the drawings, exoept that the throat area and disposal means are different. Accordingly, like numbers are used on like parts throughout the drawings and the parts which are different are separately designated with different numbers.

As shown in FIGS. 6 and 7, the body 11 at the central area 18 is formed with a downwardly extending throat 61 formed for channeling downwardly the liquid and debris 16 entering the central area 18. The floatation blocks 22A, 22B and 22C, and the ohannels 19A, 19B and 19C are formed similarly to the correspondingly-numbered parts on FIG. 1 of the drawings. Gate means 24 are pivotally mounted across the channels 19 and serve to admit floating leaves and debris 16 to the central area 18 of the housing 11 while, at the same time, retaining such floating leaves and debris in the central area pending removal.

In the form of the invention illustrated in FIGS. 6 and 7 of the drawings, the larger debris and leaves are caught in a wire mesh basket 62 removably mounted at the upper end of throat 61. When it is desired to remove the larger leaves and debris, the wire mesh basket 62 is lifted up by its bail 63 as by means of a pole with a hook on the end (not shown). The debris 16 which are small enough to pass through the meshes of basket 62 are then drawn downwardly through throat 61 to a disposal means 64.

In the form of the invention shown in FIGS. 6 and 7 of the drawings, the disposal means 64 includes a flexible conduit 66 formed at one end 67 for operative connection to the body 11 in communication with throat 61. The flexible conduit 66 has an opposite end 68 adapted for connection to a conventional pool vacuum fitting 69. With the pool vacuum intake to the pool pump turned on, water and the finer debris which pass through the mesh of the bucket 62 will be drawn through the swimming pool filter system.

In order to prevent entang1ement of the flexible conduit 66 with the water under pressure supply conduit 29, the conduit 29 is carried within flexible conduit 66 in the manner shown in FIG. 6 of the drawings. As there shown, the conduit 29 is adapted for connection to a fitting 32 in the pool wall supplying water under pressure. The conduit 29 passes through a fitting 71 and then through the interior of flexible conduit 66 to a second fitting 72 at end 67. The conduit 29 then passes into the body 11 and to conduits leading to the nozzles 31.

In order to avoid kinking of the hoses and impairment of the free movement of the skimmer about the pool, a conventional swivel connection 73 is interposed in the flexible water supply conduit 29 (see FIG. 1). Also, a concentric swivel fitting 74 is interposed in flexible conduit 66 and water supply conduit 29.

The construction of the swivel 74 may best be seen in FIG. 8 of the drawings wherein sleeves 76 and 77 are fastened to confronting ends of conduit 66 and rotate with such ends. The sleeves 74 are enlarged inwardly at their confronting ends and ride loosely in corresponding grooves 78 formed in a connector member 79. Radial struts 81 hold a swivel unit, such as the unit 73, for water supply conduit 29 in relative coaxial position with the conduit 29 inside conduit 66.

From the foregoing, it will be evident that the self-propelled floating swimming pool skimmer of the present invention as shown, described and claimed herein represents a real and major improvement in the swimming pool skimmer art, the present skimmer being capable of automatically and randomly propelling itself over the entire extent of the pool while picking up floating leaves and debris and automatically separating them from the water being returned to the pool into a disposal means which greatly facilitate removal of the skimmed leaves and debris from the pool area.

What I claim is:

1. Apparatus for removing bloating debris from the surface of a pool of liquid, comprising:

a body floatable on said pool surface;

propulsion means on said body for driving said body over said pool surface while repeatedly switching the direction of motion of said body over said pool surface among a plurality of preselected directions independently of forces external to said body, and collecting means on said body for receiving and entrapping debris, said collecting means carried on a central area of said body to cooperate with said propulsion means such that debris approached by said body as said body is driven by said propulsion means over said pool surface along each of said preselected directions is received and entrapped thereby.

2. Apparatus for removing floating debris from the surface of a pool of liquid as described in claim 1, and wherein said collecting means is comprised of a plurality of channels opening from a central area to the periphery of said body in said preselected directions at and below said pool surface to permit debris on said pool surface to pass therethrough into said central area.

3. Apparatus for removing floating debris from the surface of a pool of liquid as described in claim 2, and wherein gate means is mounted across each of said channel with each such gate means being formed for admitting surface debris and the liquid upon which such debris floats through such channel and into said central area, said gate means further being formed for retaining such debris in said central area against egress through said channels.

4. Apparatus for removing floating debris from the surface of a pool of liquid as described in claim 3, and wherein said gate means comprise flaps proportioned to extend across each of said associated channels, each of said flaps being mounted on said body across its associated channel in inwardly upwardly inclined relation with the upper edge of said flap just above the pool surface whereby debris are washed inwardly over said flap into said central area but are restrained by said upper edge of said flap from washing out of said central area.

5. Apparatus for removing floating debris from the surface of a pool of liquid as described in claim 4, and wherein each of said flaps is floatable in the liquid of the pool, said apparatus further comprising hinge means for pivotally mounting the lower edges of said flaps to said body so that said upper edges of said flaps can float up slightly above said pool surface.

6. Apparatus for removing floating debris from the surface of a pool of liquid as described in claim 1, and wherein said propulsion means comprises a plurality of horizontal angularly related liquid jets supported by said body and formed for driving said body over said pool surface as a reaction to the jet or jets which are on.

7. Apparatus for removing floating debris from the surface of a pool of liquid as described in claim 6, and wherein said apparatus further includes flexible conduit means carried at one end by said body and having an opposite end adapted for connection to a source of liquid under pressure, a plurality of nozzles formed for providing said liquid jets, and control means for selectively connecting said nozzles to said conduit means.

8. Apparatus for removing floating debris from the surface of a pool of liquid as described in claim 7, and wherein said nozzles are positioned in circumferentially spaced relation around the periphery of said body.

9. Apparatus for removing floating debris from the surface of a pool of liquid as described in claim 8, and wherein said nozzles are operatively associated in pairs, with the nozzle of each pair on opposite sides of said body.

10. Apparatus for removing floating debris from the surface of a pool of liquid as described in claim 7, and wherein said control means comprises valve means formed for automatically and selectively connecting said nozzles in desired sequence to said conduit means.

11. Apparatus for removing floating debris from the surface of a pool of liquid as described in claim 10, and wherein actuating means is provided for operating said valve means in response to the flow of said liquid through said conduit means.

12. Apparatus for removing floating debris from the surface of a pool of liquid as described in claim 11, and wherein said valve means comprises a rotary multi-port valve, said actuating means comprises a rotatable member interposed in said conduit means, and gear reducing means operatively connects said rotatable member to said rotary multi-port valve for moving the latter to connect said nozzles to said conduit means in desired sequence.

13. Apparatus for removing floating debris from the surface of a pool of liquid as described in claim 12, and wherein said rotary multi-part valve comprises a disk-shaped plate having an opening therethrough selectively registerable with sub-conduit leading to said nozzles as said disk-shaped plate rotates.

14. Apparatus for removing floating debris from the surface of a pool of liquid as described in claim 2, and wherein collecting means is carried by said body and is formed for confining said debris in said central area for removal from said pool.

15. Apparatus for removing floating debris from the surface of a pool of liquid as described in claim 14, and wherein said collecting means automatically returns liquid captured with said debris to the liquid of the pool.

16. Apparatus for removing floating debris and liquid from the surface of a pool of liquid as described in claim 15, and wherein said collecting means is formed to draw said debris and liquid from said channels into said central area and thence downwardly, and disposal means is connected to said collecting means for receiving debris therefrom.

17. Apparatus for removing floating debris from the surface of a pool of liquid as described in claim 16, and wherein said collecting means is formed to induce a downward flow of liquid and debris from said channels to said disposal means, and said disposal means is formed to separate said liquid from said debris.

18. Apparatus for removing floating debris from the surface of a pool of liquid as described in claim 17, and wherein downwardly directed liquid jet means at said central area is formed for entraining said liquid and debris for inducing said downward flow of liquid and debris.

19. Apparatus for removing floating debris from the surface of a pool of liquid as described in claim 18, and wherein said body at said central area is formed with a downwardly constricting throat for channeling the liquid and debris entering said central area downwardly to said disposal means.

20. Apparatus for removing floating debris from the surface of a pool of liquid as described in claim 19, and wherein said downwardly directed liquid jet means comprises a plurality of downwardly directed nozzles mounted in circumferentially spaced relation around the inner periphery of said throat, and a manifold for said nozzles adapted for connection to a source of liquid under pressure.

21. Apparatus for removing floating debris from the surface of a pool of liquid as described in claim 20, and wherein said nozzles are formed and angled so that the downwardly directed jets of liquid emanating therefrom describe a spiral path down said throat whereby the liquid and debris entrained by said downwardly directed jets of liquid follow a similar spiral path.

22. Apparatus for removing floating debris from the surface of a pool of liquid as described in claim 16, and wherein said body at said central area is formed with a downwardly extending throat for channeling downwardly the liquid and debris entering said central area, and said disposal means comprises an open mesh bag removably secured to said body and communicating with said downwardly extending throat.

23. Apparatus for removing floating debris from the surface of a pool of liquid as described in claim 16, and wherein said body at said central area is formed with a downwardly extending throat for channeling downwardly the liquid and debris entering said central area, and said disposal means comprises a flexible conduit formed at one end for operative connection to said body in communication with said throat and having an opposite end adapted for connection to a pool vacuum fitting.

24. A self propelled swimming pool skimmer, comprising a substantially disk-shaped floating body;

propulsion means on said body formed for urging said body over the surface of the swimming pool while repeatedly switching the direction of motion of said body over said pool surface among a plurality of preselected directions independently of forces external to said body, a plurality of circumferentially spaced radial channels formed in said body and extending below the normal waterline for admitting water and floating debris to a central area of said body , one said channel aligned with each of said preselected directions, an inclined floating gate pivotally mounted on said body in each of said channels and formed for admitting water and floating debris washing into such channel into said central area and for retaining such debris in said central area against being washed back out through said channels, and collecting means carried by said body and formed for removing said debris from said central area of said body.

25. A self propelled swimming pool skimmer as described in claim 24, and wherein disposal means is carried in operative association with said collecting means for receiving said water and debris from said central area and for retaining said debris while releasing said water back into the pool.

26. A self propelled swimming pool skimmer as described in claim 25, and wherein said body at said central area is formed with a downwardly constricting throat, and wherein said collecting means in said throat is formed for entraining said water and debris in said central area so as to induce a downward flow thereof out of said throat and into said disposal means.

27. A self propelled swimming pool skimmer as described in claim 26, and wherein said collecting means comprises a plurality of downwardly directed nozzles mounted in circumferentially spaced relation around the inner periphery of said throat, and a manifold for said nozzles adapted for connection to a source of water under pressure.

28. A self propelled swimming pool skimmer as described in claim 27, and wherein said nozzles are formed and angled so that jets of water emanating from said nozzles described a spiral path down said throat whereby the water and debris entrained by said jets of water follow similar spiral path.

29. A self propelled swimming pool skimmer as described in claim 25, and wherein said disposal means comprises an open mesh bag removably securable to the lower end of said throat for receiving water and debris therefrom.

30. A self propelled swimming pool skimmer as described in claim 25, and wherein said disposal means comprises a flexible conduit formed at one end for operative connection to said throat and having its other end adapted for connection to a swimming pool vacuum fitting.

31. A self propelled swimming pool skimmer as described in claim 24, and wherein said propulsion means comprises a plurality of horizontal angularly related water jets mounted on said body and formed for driving said body over the pool surface by reaction to those of the jets which are in operation in a direction opposite to the direction of flow of such jets.

32. A self propelled swimming pool skimmer as described in claim 31, and wherein said propulsion means further comprises a flexible conduit connectable between said body and a source of water under pressure, a plurality of nozzles formed for providing said water jets, and control means formed for automatically selectively connecting selected ones of said nozzles to said conduit.

33. A self propelled swimming pool skimmer as described in claim 32, and wherein said nozzles are positioned in circumferentially spaced relation around the periphery of said body.

34. A self propelled swimming pool skimmer as described in claim 33, and wherein said nozzles are operatively associated in pairs, with the nozzles of each pair on opposite sides of said body.

35. A self propelled swimming pool skimmer as described in claim 32, and wherein said control means comprises valve means formed for automatically and selectively connecting said nozzles in desired sequence to said conduit.

36. A self propelled swimming pool skimmer as described in claim 35, and wherein actuating means is provided for operating said valve means in response to the flow of said liquid through said conduit.

37. A self propelled swimming pool skimmer as described in claim 36, and wherein said valve means comprises a rotary multi-port valve, said actuating means comprises a rotatable member interposed in said conduit, and gear reducing means operatively connects said rotatable member to said rotary multi-port valve for moving the latter to connect said nozzles to said conduit in desired sequence.

38. A self propelled swimming pool skimmer as described in claim 37, and wherein said rotary multi-port valve comprises a disk-shaped plate having an opening therethrough selectively registrable with sub-conduits leading to said nozzles as said disk-shaped plate rotates.

* * * * *